US005885954A

United States Patent [19]

Chicarielli

[11] Patent Number: 5,885,954

[45] Date of Patent: Mar. 23, 1999

[54] STAIN REMOVER FOR TEXTURED WALLS AND CEILINGS

[75] Inventor: Peter Chicarielli, Wall Township, N.J.

[73] Assignee: TPC Enterprise, Inc., Wall Township, N.J.

[21] Appl. No.: 934,962

[22] Filed: Sep. 22, 1997

[51] Int. Cl.[6] ..... C11D 3/395; C11D 7/54; C11D 3/37; C11D 17/06

[52] U.S. Cl. ..... 510/380; 510/199; 510/240; 510/242; 510/238; 510/363; 510/382; 510/434

[58] Field of Search ..... 510/199, 363, 510/367, 533, 242, 240, 238, 434, 380, 382

[56] References Cited

U.S. PATENT DOCUMENTS

| | | | |
|---|---|---|---|
| 3,172,861 | 3/1965 | Steinhauer et al. | 252/187 |
| 3,498,924 | 3/1970 | Walsh et al. | 252/187 |
| 3,630,923 | 12/1971 | Simmons et al. | 252/99 |
| 3,640,878 | 2/1972 | Chirash et al. | 252/99 |
| 3,671,440 | 6/1972 | Sabatelli et al. | 252/103 |
| 4,071,463 | 1/1978 | Steinhauer . | |
| 4,097,395 | 6/1978 | Posey et al. | 252/106 |
| 4,164,477 | 8/1979 | Whitley . | |
| 4,277,853 | 7/1981 | McDuffee . | |
| 4,329,247 | 5/1982 | Palmer . | |
| 4,579,676 | 4/1986 | Bull | 252/94 |
| 4,681,696 | 7/1987 | Bruegge et al. | 252/99 |
| 4,935,065 | 6/1990 | Bull | 134/22.13 |
| 4,944,892 | 7/1990 | Leathers et al. | 252/92 |
| 5,281,280 | 1/1994 | Lisowski et al. | 134/26 |
| 5,605,578 | 2/1997 | Hawes et al. | 134/36 |
| 5,610,126 | 3/1997 | Barford et al. . | |
| 5,705,467 | 1/1998 | Choy | 510/370 |

*Primary Examiner*—Alan Diamond
*Assistant Examiner*—John M. Petruncio
*Attorney, Agent, or Firm*—J. De La Rosa

[57] ABSTRACT

The present invention is a powdered stain remover formulation which when mixed with water exhibits bleaching and stain discoloration properties together with the required detergency, and also exhibits mildewcide and bacteriocidal properties. The formulation includes calcium hypochlorite; a surfactant to promote detergency by emulsification, such as sodium dodecylbenzene sulfonate and a polyacrylic acid salt, such as sodium polyacrylate, to further promote cleaning by chelation. The stain remover formulation is applied to the stained surface by spraying, rolling or brushing. In this manner, water stains, tobacco, soot, mold, mildew and other stains are readily removed from the desired surface, such as sprayed textured walls and ceilings, tiles, masonry, fiberglass and plastic furniture. Importantly, this is done so without any further need to rub or wipe the surface

31 Claims, No Drawings

STAIN REMOVER FOR TEXTURED WALLS AND CEILINGS

FIELD OF THE INVENTION

The present invention generally relates to the preparation of a formulation useful in the removal of stains on walls, ceilings, vinyl and brick and, more particularly, to such a formulation which is useful in the removal of water stains, tobacco, soot and other stains on sprayed textured ceiling and walls.

BACKGROUND OF THE INVENTION

The removal of discoloration stains, such as water stains, mold, mildew, tobacco and soot, from walls, ceilings, shower curtains, tiles and like surfaces, is a particularly annoying problem. The removal of such stains on sprayed textured ceilings and walls is even more troublesome. A variety of detergent compositions are available for removing the stains, but require extensive rubbing or wiping which usually destroys the texture or finish, particularly for textured ceilings and walls. Liquid bleach products are also available to remove those stains, but unless great care is exercised, they also destroy the finish or texture of the surface. Although an option, repainting or replacing the stained surface is possible, but is typically cost prohibitive.

The present invention relates to a formulation which has been found to be particularly successful when used for removal of such stains wherein the labor required for removal is significantly reduced. Indeed, by simply spraying, brushing or rolling the formulation on the desired surface, the stains are removed without the need for further rubbing or wiping.

SUMMARY OF THE INVENTION

The present invention is a powdered stain remover formulation which when mixed with water exhibits both bleaching and detergency properties. The formulation includes calcium hypochlorite; a halogen oxidizer stable surfactant to promote detergency by emulsification, such as sodium dodecylbenzene sulfonate, and a water soluble anionic polymer, such as sodium polyacrylate, to further promote detergency by chelation. The formulation may also include other cleaning additives that function to still further promote detergency.

Accordingly, an object of the present invention is to provide a novel stain remover formulation for removing water stains, tobacco, soot, mold, and mildew and other stains from textured ceilings, walls, tiles, masonry, grout, fiberglass and plastic patio furniture.

Another object of the invention is to provide a novel stain remover formulation which may simply be sprayed, brushed or rolled onto the desired surface without further need to rub or wipe the surface.

Still another object of the invention is to provide a novel method for removing stains from sprayed textured ceilings and walls, and like surfaces.

DETAILED DESCRIPTION

The stain remover formulation of the present invention is a powdered mixture containing: calcium hypochlorite as an oxidizer; a halogen oxidizer stable surfactant; a water soluble anionic polymer; and various additives to further promote detergency. The powdered mixture is prepared in a separate vessel to yield a homogenous powdered composition. When ready for use, the powdered mixture is mixed with water to yield an aqueous solution.

The amount of the ingredients are chosen to give the desired level of bleaching, detergency and stability in the final aqueous solution. The amounts may be varied within generally wide limits. However, the amount of calcium hypochlorite will usually not exceed about 5% by weight of the final aqueous solution for general household use, and preferably will be in the range of about 3–8 weight percent, the surfactant in the range of about 0.1–10 weight percent and the water soluble anionic polymer in the range of about 0.1–10 weight percent.

In the final working aqueous solution, which is preferably sprayed onto the desired surface, the formulation is mixed with water at a concentration range of about 3–8 weight percent. That is, the stain remover formulation is primarily intended for use in an aqueous solution containing about 3–8% of the powdered formulation and the balance water.

As indicated, the stain remover formulation is applied to the stained surface by spraying, rolling or brushing. In this manner, water stains, tobacco, soot, mold, mildew and other stains are readily removed from the targeted surfaces, such as textured walls and ceilings, tiles, masonry, plastic and fiberglass and plastic patio furniture. Importantly, this is done without any further need to rub or wipe the surface.

In accordance with the present invention, the preferred oxidizer is calcium hypochlorite at a concentration of between about 5% and 99% in the powdered formulation. For most applications, however, the concentration is between about 60–80% weight. Calcium hypochlorite is widely commercially available. As an oxidizer, calcium hypochlorite interacts with the color producing organic compounds found in most common stains and more specifically, the chromophoric groups that possess "mobile" electrons. In the presence of light, these "mobile" electrons absorb energy and re-emit a portion of that energy in the form of light. Discoloration results from the different wavelengths of the re-emitted light. Advantageously, calcium hypochlorite attacks the chromophoric groups and removes "mobile" electrons so that the organic compounds can no longer emit light at wavelengths perceivable as color. Its high active chlorine content and rapid solubility further adds to its bleaching and discoloration detergency properties.

In certain applications, calcium hydroxide at concentrations less than about 4% may also be used to promote detergency by solubilizing rust stains. Moreover, calcium hydroxide exacerbates the reactivity of the free chlorine in calcium hypochlorite to enhance the overall stain removal property of the formulation.

Surfactants suitable for use in accordance with present invention are halogen oxidizer stable surfactants, which do not readily react with, but dissolve in calcium hypochlorite solution. Such surfactants function to disperse the ingredients and wet the surface being treated. The following surfactants may be added to the formulation: alkyl aryl sulfonate salts, alkyl sulfonate salts, alkyl sulfate salts, alkyl carboxylate salts, and alkyl diphenyloxide disulfonate salts. The preferred surfactant agent, however, is sodium dodecylbenzene sulfonate, which is commercially available under the trade name Calsoft F-90 from Pilot Chemical.

The above surfactants form miscelle agents which promote detergency through a process called "emulsification," particularly for stains which typically do not dissolve in water, such stains either being oil based or having an affinity for oil. So-called "miscelle agents" contain molecules having an affinity for water as well as molecules having an affinity for oil. In emulsification, the stain is surrounded by the miscelle agent, with those molecules having an affinity for oil oriented toward the stain. Those molecules having an affinity for water, however, are oriented toward the water. And, it is through this emulsification of the stain that the stain removal properties are primarily enhanced. Additionally, such surface active agents lower the surface tension of the stained surface to further enhance the stain removal properties.

If desired, fillers may be added, such as sodium sulfate or neutral salts, being contained in the powdered formulation up to about 40 weight percents or in the range of 5 to 40 percent weight. The following inert fillers may be added to the formulation: alkali metal chlorides; alkali metal sulfates; alkali metal carbonates; alkaline earth metal sulfates and alkaline earth metal carbonates.

In order to further promote detergency, the formulation of the present invention includes water soluble anionic polymers, including salts of polyacrylic acid, salts of polyacrylamides; salts of polymaleic acid; salts of polymaelic/acrylic acid copolymers; or salts of polyalkyacrylic acid. Preferably, a polyacrylic acid salt, such as sodium polyacrylate is used, which is available under the trade name Sokalan Pa25 from BASF Corporation. A polyacrylic acid salt specifically promotes detergency through chelation of transition metal and divalent metal ions, typically found in rust stains. More particularly, polyacrylic acid salts chemically react with metal cations so as to form temporary chemical bonds with the metal ions. By combining with the metal ions, the chelate prevents the metal ions from reacting with other materials and forming residues not readily removable with water.

Minor amounts up to about 1 weight percent of the powdered formulation, of disinfectant may also be included in the formulation to kill mold, mildew and act as a bactericide.

The ingredients of the powdered stain remover formulation may be present in the range set forth in Table 1 below.

TABLE 1

| Ingredient | Range in % by Weight |
|---|---|
| Calcium Hypochlorite | 5–99% |
| Halogen Oxidizer Stable Surfactant | 0.1–10% |
| Water Soluble Anionic Polymer | 0.1–10% |
| Inert ingredients | 5–40% |

In order to provide a basis for the disclosure of the various aspects of the present invention, the following specific composition of the powdered formulation is provided:

EXAMPLE

| Ingredient | % by Weight |
|---|---|
| Calcium Hypochlorite | 63.7% |
| Calcium Hydroxide | 3.9% |
| Sodium Dodecylbenzene Sulfonate | 1% |
| Sodium Sulfate | 0.02% |
| Sodium Polyacrylate | 1% |
| Other Inert Constituents | 30.38% |

The calcium hypochlorite may be used within a percent weight range of up to 99% in the powdered formulation, but is preferably in the range of 60–80%. With the working stain remover solution being the formulation in the above example, it is preferably mixed in water so as to represent about 3–4% weight of the final aqueous working solution.

Formulations were prepared containing the ingredients as set forth above in the example. The calcium hypochlorite concentration of the powder was determined by titration to measure the rate at which the oxidizer disappeared so as to extrapolate the number of days when half of the calcium hypochlorite was used up, that is the so-called "half-life." Such measurements indicated a half-life of approximately 30 days for the above formulation at room temperature.

To treat either textured surfaces, stones, tiles and like surfaces, the ratio of the amount of the above example to water is about 10–30 grams of the powdered formulation to 22 fluid ounces of water, with 20 grams preferable. To apply the stain remover formulation solution, it is convenient to use a bottle sprayer that has been filled with the correct proportion of water and powdered stain remover formulation. The powdered stain remover formulation is first emptied into the spray bottle and then mixed with water to yield a fairly homogenous solution. The solution is then sprayed, brushed or rolled over the stained surface, with no need to scrub or rub. In most instances, the stain disappears within about five to ten minutes after application. If necessary, a second treatment may be applied for stubborn stains.

The stain remover formulation of the present invention is effective in removing water stains, tobacco, soot, mold, and mildew, which may be present on a variety of surfaces, such as textured surfaces, stone, brick, tile, vinyl and plastics. The solution may be applied with a large variety of applicators, including rollers, brushes, sponges, paint sprayers and the like.

I claim:

1. a powdered composition which when added to water produces a stain remover solution, the powdered composition consisting essentially of:

a) calcium hypochlorite with a weight percent ranging from about 60 to 99 weight percent;

b) a halogen oxidizer stable surfactant that is soluble in calcium hypochlorite solution and that is present in an amount ranging from about 0.1 to 10 weight percent; and c) an anionic polymer soluble in water with a weight percent ranging from 0.1 to 10 weight percent.

2. The powdered composition as defined in claim 1 wherein said halogen oxidizer stable surfactant is elected from the group consisting of alkyl aryl sulfonate salts, alkyl sulfonate salts, alkyl sulfate salts, alkyl carboxylate salts, and alkyl diphenyloxide disulfonate salts.

3. The powdered composition as defined in claim 1 wherein said anionic polymer is selected from the group consisting of salts of polyacrylic acid, salts of polyacrylamides, salts of polymaleic acid, salts of polymaleic/acrylic copolymer, and salts of polyalkylacrylic acid.

4. The powdered composition as defined in claim 1 wherein said formulation is present in an aqueous working solution comprising at least 97% water.

5. The powdered composition as defined in claim 1 wherein said surfactant is sodium dodecylbenzene sulfonate.

6. The powdered composition as defined in claim 1 containing up to 40% inert ingredients.

7. The powdered composition as defined in claim 6 wherein said inert ingredients are selected from the group consisting of alkali metal chlorides, alkali metal sulfates, alkali metal carbonates, alkaline earth metal sulfates, and alkaline earth metal carbonates.

8. The powdered composition as defined in claim 1 containing up to about 4% weight of calcium hydroxide.

9. The powdered composition as defined in claim 1 wherein the formulation is present in a working aqueous solution between about 3–8% weight percent.

10. A method of removing stains from a textured surface comprising applying an aqueous solution of an about 3 to 8 weight percent of the powdered composition of claim 1, to said textured surface.

11. The method as defined in claim 10 wherein said halogen oxidizer stable surfactant is selected from the group consisting of alkyl aryl sulfonate salts, alkyl sulfonate salts, alkyl sulfate salts, alkyl carboxylate salts, and alkyl diphenyloxide disulfonate salts.

12. The method as defined in claim 10 wherein said anionic polymer is selected from the group consisting of salts of polyacrylic acid, salts of polyacrylamides, salts of polymaleic acid, salts of polymaleic/acrylic copolymer, and salts of polyalkylacrylic acid.

13. The method as defined in claim 10 wherein said surfactant is sodium dodecylbenzene sulfonate.

14. The method as defined in claim 10 wherein said powdered composition contains up to about 40% inert ingredients.

15. The method as defined in claim 14 wherein said inert ingredients are selected from the group consisting of alkali metal chlorides, alkali metal sulfates, alkali metal carbonates, alkaline earth metal sulfates, and alkaline earth metal carbonates.

16. The method as defined in claim 10 wherein said powdered composition contains up to about 4% weight of calcium hydroxide.

17. The powdered composition of claim 1 which, when added to water, produces an aqueous stain remover solution that does not destroy the finish or texture of a surface treated with the aqueous stain remover.

18. The powdered composition of claim 1 wherein the calcium hypochlorite is present in a weight percent ranging from about 60 to 80 weight percent.

19. The powdered composition of claim 1, which when added to water, produces an aqueous stain remover solution effective to remove stains from surfaces selected from the group consisting of a textured surface, a stone surface, a brick surface, a tile surface and a plastic surface.

20. The powdered composition of claim 6 wherein the inert ingredients are present in an amount ranging from about 5 to 40%.

21. The method of claim 10 wherein the surface is selected from the group consisting of textured ceilings, walls, tiles, masonry, grout, fiberglass, and plastic patio furniture.

22. The method of claim 10 wherein no wiping or rubbing of the textured surface is required.

23. The method of claim 10 wherein the stains that the aqueous stain remover solution is effective to clean are selected from the group consisting of water, tobacco, soot, mold and mildew stains.

24. The method of claim 10 wherein the surface to be cleaned are sprayed textured walls or ceilings.

25. The method of claim 10 wherein surfaces treated with the stain remover solution are not destroyed by said treatment.

26. The method of claim 10 wherein the calcium hypochlorite is present in the powdered composition with a weight percent ranging from about 60 to 80 weight percent.

27. The method of claim 10 wherein the powdered composition also consists of up to about 40 weight percent inert ingredients.

28. The powdered composition of claim 1 that also consists of a disinfectant in an amount of about 1 weight percent.

29. A bottle sprayer comprising an aqueous stain remover solution comprising about 3 to 8 weight percent of the powdered composition of claim 1.

30. The powdered composition of claim 1 consisting essentially of

| | |
|---|---|
| calcium hypochlorite | 63.7%; |
| calcium hydroxide | 3.9%; |
| sodium dodecylbenzene sulfonate | 1%; |
| sodium sulfate | 0.02%; |
| sodium polyacrylate | 1%; and |
| inert constituents | 30.38%. |

31. The method of claim 10, wherein the aqueous stain remover solution is applied to said surface by a method selected from the group consisting of spraying, brushing and rolling.

* * * * *